US005248406A

United States Patent [19]

Kamitani

[11] Patent Number: 5,248,406

[45] Date of Patent: Sep. 28, 1993

[54] ELECTROPLATING BATH SOLUTION FOR ZINC ALLOY AND ELECTROPLATED PRODUCT USING THE SAME

[75] Inventor: Masaaki Kamitani, Machida, Japan

[73] Assignee: Ebara-Udylite Co., Ltd., Tokyo, Japan

[21] Appl. No.: 917,692

[22] Filed: Mar. 6, 1991

[51] Int. Cl.[5] ..... C25D 3/56

[52] U.S. Cl. ..... 205/245; 106/1.29

[58] Field of Search ..... 205/244, 245; 106/1.29

[56] References Cited

U.S. PATENT DOCUMENTS

| | | | |
|---|---|---|---|
| 4,488,942 | 12/1984 | Martin et al. | 205/245 |
| 4,581,110 | 4/1986 | Tsuchida et al. | 205/245 |
| 4,717,458 | 1/1988 | Martin et al. | 205/245 |
| 4,983,263 | 1/1991 | Yosuda et al. | 205/245 |

FOREIGN PATENT DOCUMENTS 2094349 9/1982 United Kingdom .

*Primary Examiner*—John Niebling
*Assistant Examiner*—Brian M. Bolam
*Attorney, Agent, or Firm*—Oblon, Spivak, McClelland, Maier & Neustadt

[57] ABSTRACT

An electroplating bath solution for zinc-cobalt-iron alloy and electroplated product electroplating by the bath solution are described.

The electroplating bath solution containing 5-30 g/l Zn, 0.01-0.3 g/l Co and 0.02-0.5 g/l Fe, and electroplating layer of the product contains 0.1-0.6 wt % Co, 0.2-0.7 wt % Fe and Zn.

The electroplated product gives a high quality black chromate film at cheaper cost than before.

3 Claims, No Drawings

ELECTROPLATING BATH SOLUTION FOR ZINC ALLOY AND ELECTROPLATED PRODUCT USING THE SAME

BACKGROUND OF THE INVENTION

1. Field of the Invention

This invention relates a zinc-cobalt-iron alloy electroplating bath solution and a zinc alloy plated product which is able to form a satisfied plated product having a black chromate film by treating with a chromate solution containing no silver.

2. Description of the Prior Art

As chromate treatment of zinc plating is extremely effective in improving corrosion resistance, it is being carried out in many fields. The types of chromate normally used are bright chromate having metal brightness, color chromate in which corrosion resist is particularly good, green chromate, black chromate, etc. but in the recent years, from the advantages of design and fashion, the demand for black chromate is increasing.

However, as black chromate was obtained traditionally by treating a zinc plated product with silver containing chromate solution made up by adding silver nitrate to mainly anhydrous chromic acid or the corrosion resist of the film being made poorer than color chromate due to the effects of silver being in the chromate film.

In order to resolve these problems, it is proposed that a zinc-iron alloy plating which co-deposits 0.2–0.8% (hereinafter indicated merely by "%") iron on zinc be used as base plating. By treating this alloy plating deposit with chromate solution not containing silver, it gives a good corrosion resist black chromate film. However, in this black chromate obtained by this method, compared to the chromate film formed by the ordinary chrome plating, it has the shortcoming of heat resist being slightly poorer and for parts being used in the engine room of the automobile, it would not be able meet the heat resist requirements.

In consideration of traditional technology concerning formation of black chromate film on zinc plated product having the problems explained above, the object of this invention is to provide a way to form a black chromate film excelling in corrosion resist, heat resist with a chromate solution not containing silver on a zinc plated product.

SUMMARY OF THE INVENTION

This invention provides an electroplated product with zinc type alloy which has been completed and based on a new concept to the effect that excellent black chromate even with chromate solution not containing silver can be given to a zinc-cobalt-iron alloy electrodeposit in which a special component plating deposit; i.e., Co content 0.1–0.6 wt %, Fe content 0.2–0.7 wt % is obtained from an alkali zinc plating solution containing very small amounts of cobalt and iron.

This invention also provides zinc alloy electroplating bath solution comprising zincate as 5–30 g/l Zn, cobalt ion forming a chelate compound as 0.01–0.3 g/l Co, iron ion forming a chelate compound as 0.02–0.5 g/l Fe and the pH being more than 13. This invention further provides a method of producing an electroplated product having a black chromate film comprising treatment of an electroplated product with the above zinc type alloy with a chromate solution not containing any silver.

DETAILED DESCRIPTION OF THE INVENTION AND PREFERRED EMBODIMENT

In an electroplated product having a plating deposit made up of zinc-cobalt-iron ternary alloy, if the Co is less than 0.1%, the heat resist after chromate treatment is not sufficient and also, if Co exceeds 0.6%, prevention of white rust after chromate treatment worsens. On the other hand, if Fe is less than 0.2%, sufficient prevention of white rust cannot be obtained, and also, if 0.7% is exceeded, the reactivity with the chromate solution worsens, a chromate film with sufficient blackness cannot be obtained. Furthermore, even if Fe is less than 0.7%, it the total amount with Co exceeds 0.8%, the reactivity with the chromate solution worsens, the color of the film becomes only a light black.

Next, the production method of the above zinc type alloy electroplated product by this invention is explained.

Reading the main ingredient of plating solution, for zinc supply source of zincate, ZnO, $ZnSO_4.7H_2O$, $ZnCl_2.6H_2O$, etc., for supply source of cobalt ion, $CoSO_4.7H_2O$, $CoCl_2.H_2O$, etc., for supply source of iron ion, $FeSO_4.7H_2O$, $FeCl_3.6H_2O$, etc. can be used respectively, for zinc compound, by adding approx. 60–180 g/l caustic soda or caustic potash and making the pH of the plating solution more than 13, it makes the zincate solution stable. For cobalt compound and iron compound, by forming chelate compound by sufficient amount of adequate chelating agent, it makes the solution stable.

The concentration of the various metals are as explained above. With Zn at less than 5 g/l, a practical cathode current density cannot be obtained and on the other hand, if it exceeds 30 g/l, uniform plating appearance cannot be obtained. If Co and Fe concentrations exceeds the above ranges. The specific plating deposit composition of zinc-cobalt-iron alloy electroplated product of this invention cannot be obtained.

As chelating agents for cobalt ion and iron ion, various kinds can be used but depending on the type of chelating agent, the co-deposition rate of Co and Fe on the plating deposit and ductility and hardness of the plating deposit can be affected. The chelating agents particularly desirable are gluconic acid salt, glucoheptone acid salt, citric acid salt, sorbitol, etc. It is desirable that concentration of chelating agent will be kept more than 0.005 mole/l in the plating solution. In the case the concentration is less than the above, the cobalt ion and iron ion becomes unstable, and the plating deposition becomes rough. There is no problem if the chelating agent is added slightly in excess.

Also in the plating solution, to make the plating deposit minute for obtaining a bright plated appearance, an adequate amount of brightener is added. For this brightener, it is possible to use brightener generally used in alkali zinc plating solution but among them, reacted matter of amine such as ethylenediamine, propylenediamine, diethylenetriamine, etc. with epichlorohydrin is most adequate. For products on the market, LZ-50RMU, ELZ-500BL, OCA-88, etc. (all Ebara-Udylite products) are available. Also, to obtain an excellent bright appearance, it is desirable that aromatic aldehyde (for example, vanillin) as secondary brightener be used together.

The standard operating conditions of the method of this invention are shown in the following.

Cathode Current Density: 0.1–10 $A/dm^2$

Anode Current Density: 1–10 A/dm$^2$

Bath Temperature: 15°–35° C.

Anode: Zinc for soluble anode. For insoluble anode, carbon, stainless steel, etc. can be used.

Supply of Metal: Zinc dissolved from the anode or addition of zinc oxide made. For cobalt and iron, these met al salts added.

The zinc-cobalt-iron alloy electroplated product by this invention excels in corrosion resist as is but a black chromate film is obtained by using any chromate solution but to obtain particularly good results, treat with green chromate solution not containing silver. For chromate treatment, after plating, thoroughly rinse under normal rinsing method, immerse 30–60 sec. in chromate solution at 20°–35° C., and dry that. No special operating conditions needed.

EXAMPLES

The following explains this invention with examples and comparisons. Furthermore, all the plating in the following examples are carried out by using 267 ml hull cell and operating conditions are as follows.

Current: 2A

Plating Time: 10 min.

Bath Temperature: 25° C.

Anode: Zinc

Cathode: Bright steel sheet

Also, after plating, chromate treatment was carried out the chromate solution is used as follows.

(1) Green Chromate C-75S

Used in all examples and comparisons 1–6. Chromate for zinc plating and contains no silver.

(2) Black Chromate C-79A AND C-79B

Used in comparison 7. C-79B chromate for zinc plating contains silver. (All Ebara-Udylite Co., Ltd. products)

Bath Temperature: 25° C.

Treatment Time: 40 sec.

Example 1

Plating Bath Composition: NaOH 120 g/l, ZnO 10 g/l, (8 g/l as Zn) $CoSO_4.7H_2O$ 0.2 g/l (0.042 g/l as Co), $FeCl_3.6H_2O$ 0.20 g/l (0.042 g/l as Fe), Sodium gluconate 30 g/l (0.14 mole/l), Brightener LZ-50RMU (Ebara-Udylite Co., Ltd.) 4 ml/l.

As a result of Hull Cell Test, a plating deposit with uniform brightness was obtained on the full surface of the test panel. The Co and Fe co-deposition rate at the center of the test panel was 0.32% and 0.20% respectively.

In the chromate treatment after plating, an uniform black chromate film was formed on the full surface of the test panel.

Example 2

Plating Bath Composition: NaOH 180 g/l, ZnO 37.5 g/l, (30 g/l as Zn), $CoCl_2.6H_2O$ 0.20 g/l (0.05 g/l as Co), $FeCl_3.6H_2O$ 2.23 g/l (0.46 g/l as Fe), Sodium Gluconate 80 g/l (0.37 mole/l), Brightener LZ-50RMU(Ebara-Udylite Co., Ltd.) 4 ml/l.

As a result of Hull Cell Test, with the exception of slight burns generated in the high current density area, a plating deposit with uniform brightness was obtained on the full surface of the test panel. The Co and Fe co-deposition rate at the center of the test panel was respectively 0.12% and 0.65%.

In the chromate treatment after plating, an uniform black chromate film was formed on the full surface of the test panel.

Example 3

Plating Bath Composition: NaOH 160 g/l, ZnO 37.5 g/l, (30 g/l as Zn), $CoCl_2.6H_2O$ 1.0 g/l (0.25 g/l as Co), $FeCl_3.6H_2O$ 0.68 g/l (0.14 g/l as Fe), Sodium Glucoheptonate 80 g/l (0.32 mole/l), Brightener LZ-50RMU 4 ml/l.

As a result of Hull Cell Test, with the exception of slight burns generated in the high current density area, a plating deposit with uniform brightness was obtained on the full surface of the test panel. The Co and Fe co-deposition rate at the center of the test panel was respectively 0.58% and 0.18%.

In the chromate treatment after plating, an uniform black chromate film was formed on the full surface of the test panel.

Example 4

Plating Bath Composition: NaOH 160 g/l, ZnO 20 g/l (16 g/l as Zn), $CoCl_2.6H_2O$ 0.32 g/l (0.079 g/l as Co), $FeSO_4.7H_2O$ 0.50 g/l (0.10 g/l as Fe), Sodium Citrate (2 hydrate) 80 g/l (0.27 mole/l), Brightener LZ-50RMU 4 ml/l.

As a result of Hull Cell Test, with the exception of slight rough deposit generating in the low current density area, a plating deposit with uniform brightness was obtained. The Co and Fe co-deposition rate at the center of the test panel was respectively 0.30% and 0.25%.

In the chromate treatment after plating, an uniform black chromate film was formed on the full surface of the test panel.

Example 5

Plating Bath Composition: NaOH 80 g/l, ZnO 6.25 g/l (5 g/l as Zn), $CoSO_4.7H_2O$ 0.057 g/l (0.012 g/l as Co), $FeCl_3.6H_2O$ 0.11 g/l (0.023 g/l as Fe), Sodium Gluconate 2 g/l (0.0092 mole/l), Brightener LZ-50RMU 4 ml/l.

As a result of Hull Cell Test, a plating deposit with uniform brightness was obtained on the full surface of the test panel. The Co and Fe co-deposition rate at the center of the test panel was 0.14% and 0.22% respectively.

In the chromate treatment after plating, an uniform black chromate film was formed on the full surface of the test panel.

Example 6

Plating Bath Composition: NaOH 120 g/l, ZnO 10 g/l (8 g/l as Zn), $CoCl_2.6H_2O$ 0.04 g/l (0.01 g/l as Co), $FeCl_3.6H_2O$ 0.40 g/l (0.083 g/l as Fe), Sodium Gluconate 100 g/l (0.46 mole/l), Brightener LZ-50RMU 4 ml/l, Anisaldehyde 0.02 g/l.

As a result of Hull Cell Test, a plating deposit with uniform brightness was formed on the full surface of the test panel. The Co and Fa co-deposition rate at the center of the test panel was 0.10% and 0.46% respectively.

In the chromate treatment after plating, an uniform black chromate film was formed on the full surface of the test panel.

Example 7

Plating Bath Composition: NaOH 120 g/l, ZnO 10 g/l (8 g/l as Zn), $CoCl_2.6H_2O$ 0.12 g/l (0.03 g/l as Co), $FeCl_3$. $6H_2O$ 0.24 g/l (0.05 g/l as Fe), Sorbit 1 g/l (0.0055 mole/l), Brightener LZ-50RMU 4 ml/l, Vanillin 0.04 g.l.

As a result of Hull Cell Test, a plating deposit with uniform brightness was formed on the full surface of the test panel. The Co and Fe co-deposition rate at the center of the test panel was respectively 0.28% and 0.26%.

In the chromate treatment after plating, an uniform black chromate film was formed on the full surface of the test panel.

Comparison 1

Plating Bath Composition: NaOH 120 g/l, ZnO 10 g/l (8 g/l as Zn), $CoCl_2.6H_2O$ 0.24 g/l (0.06 g/l as Co), $FeCl_3.6H_2O$ 0.50 g/l (0.104 g/l as Fe), Sodium Gluconate 40 g/l (0.18 mole/l), Brightener LZ-50RMU 4 ml/l.

As a result of Hull Cell Test, a plating deposit with uniform brightness was formed on the full surface of the test panel. The Co and Fe co-deposition rate at the center of the test panel was respectively 0.46% and 0.56%.

The chromate film obtained in the chromate treatment after plating was blue colored and the appearance was uneven.

Comparison 2

Plating Bath Composition: NaOH 120 g/l, ZnO 6.25 g/l (5 g/l as Zn), $CoCl_2.6H_2O$ 0.032 g/l (0.008 g/l as Co), $FeCl_3.6H_2O$ 0.087 g/l (0.018 g/l as Fe), Sodium Gluconate 2 g/l (0.009 mole/l), Brightener LZ-50RMU 4 ml/l.

As a result of Hull Cell Test, a plating deposit having brightness was obtained but at the low current density, the deposit was rough. The Co and Fe co-deposition rate at the center of the test panel was respectively 0.08% and 0.17%.

The chromate film obtained in the chromate treatment after plating had even appearance but did not become black and was a dark green color.

COMPARISON 3

Plating Bath Composition: NaOH 120 g/l, ZnO 10 g/l(8 g/l as Zn), $CoCl_2.6H_2O$ 0.24 g/l(0.06 g/l as Co), $FeCl_3.6H_2O$ 0.087 g/l (0.018 g/l as Fe), Sodium Gluconate 40 g/l (0.18 mole/l), Brightener LZ-50RMU 4 ml/l.

As a result of Hull Cell Test, a plating deposit with uniform brightness was obtained on the full surface of the test panel. The Co and Fe co-deposition rate at the center of the test panel was respectively 0.48% and 0.11%.

In the chromate treatment after plating, an uniform black chromate film was obtained on the full surface of the test panel.

COMPARISON 4

Plating Bath Composition: NaOH 120 g/l, ZnO 10 g/l(8 g/l as Zn), $CoCl_2.6H_2O$ 0.03 g/l(0.0074 g/l as Co), $FeCl_3.6H_2O$ 0.50 g/l (0.104 g/l as Fe), Sodium Gluconate 40 g/l (0.18 mole/l), Brightener LZ-50RMU 4 ml/l.

As a result of Hull Cell Test, a plating deposit with uniform brightness was obtained on the full surface of the test panel. The Co and Fe co-deposition rate at the center of the test panel was respectively 0.06% and 0.58%.

In the chromate treatment after plating, an uniform black chromate film was formed on the full surface of the test panel.

COMPARISON 5

Plating Bath Composition: NaOH 120 g/l, ZnO 6.25 g/l(5 g/l as Zn), $CoSO_4.7H_2O$ 0.30 g/l(0.063 g/l as Co), Sodium Gluconate 40 g/l (0.18 mole/l), Brightener LZ-50RMU 4 ml/l.

As a result of Hull Cell Test, a plating deposit with uniform brightness was obtained on the full surface of the test panel. The co-deposition rate of Co at the center of the test panel was 0.60%.

In the chromate treatment after plating, an uniform black chromate film was formed on the full surface of the test panel.

COMPARISON 6

Plating Bath Composition: NaOH 120 g/l, ZnO 6.25 g/l(5 g/l as Zn), $FeCl_3.6H_2O$ 0.50 g/l(0.104 g/l as Fe), Sodium Gluconate 40 g/l (0.18 mole/l), Brightener LZ-50RMU 4 ml/l.

As a result of Hull Cell Test, a plating deposit with uniform brightness was obtained on the full surface of the test panel. The Fe co-deposition rate at the center of the test panel was 0.53%.

In the chromate treatment after plating, an uniform black chromate film was formed on the full surface of the test panel.

COMPARISON 7

Plating Bath Composition: NaOH 120 g/l, ZnO 6.25 g/l(5 g/l as Zn), Brightener LZ-50RMU 4 ml/l, Vanillin 0.08 g/l.

As a result of Hull Cell Test, a plating deposit with uniform brightness was formed on the full surface of the test panel.

In the chromate treatment after plating, an uniform black chromate film was formed on the full surface of the test panel.

The chromate treated test panels obtained from the above examples were corrosion resist and heat resist tested under the following conditions.

Results as per Table 1.

Corrosion Resist Test:

Continuous salt spray test per JIS-H-2371 Standard.

Time H(Hr) up to appearance of white rust and red rust appearance rate R(%) after 1,200 hrs were measured.

Heat Resist Test:

After heat treating 4 hr. at 150° C., continuous salt spray test per JIS-Z-2371 was carried out and red rust appearance rate S(%) after 480 hr. was measured.

TABLE 1

| | Black Appearance | Corrosion H(Hr) | Resist R(%) | Heat Resist S(%) |
|---|---|---|---|---|
| Example | | | | |
| 1 | Good | 216 | 10 | 20 |
| 2 | Good | 240 | 10 | 30 |
| 3 | Good | 192 | 20 | 20 |
| 4 | Good | 192 | 20 | 30 |
| 5 | Good | 240 | 20 | 30 |
| 6 | Good | 240 | 10 | 30 |
| 7 | Good | 192 | 20 | 30 |
| Comparison | | | | |
| 1 | Poor | 72 | 50 | 40 |
| 2 | Poor | 192 | 70 | 80 |
| 3 | Good | 96 | 80 | 70 |
| 4 | Good | 216 | 80 | 90 |

TABLE 1-continued

| | Black Appearance | Corrosion H(Hr) | Resist R(%) | Heat Resist S(%) |
|---|---|---|---|---|
| 5 | Good | 72 | 70 | 70 |
| 6 | Good | 240 | 100 | 100 |
| 7 | Good | 48 | 100 | 100 |

As can be seen from TABLE 1, the test panels of Examples excelled in both corrosion resist and heat resist but the test panel of Comparisons, even though the black appearances were good, it was inferior in corrosion resist and heat resist.

EFFECT OF THE INVENTION

As explained above, the zinc type electroplated product of this invention when treated with normal chromate solution not containing silver, it is given a black chromate film with uniform and excellent appearance. And, its corrosion resist, heat resist greatly excels those of conventional zinc type plating chromate film. Consequently, according to this invention, it is possible to provide a zinc electroplated product having a high quality black chromate film at cheaper cost than before.

I claim:

1. An electroplating bath solution comprising:

5–30 g/l Zn as zincate, 0.01–0.3 g/l Co as a cobalt ion chelate compound, 0.02–0.5 g/l Fe as an iron ion chelate compound, and wherein the pH of said solution is more than 13.

2. The electroplating bath solution of claim 1, wherein said cobalt ion chelate compound and said iron ion chelate compound contain a chelating agent which is a gluconic acid salt, glucoheptone acid salt or citric acid salt.

3. The electroplating bath solution of claim 1, further comprising a reacted product of an amine and epichlorohydrin as a brightener.

* * * * *